US010752006B2

(12) United States Patent
Otsuki

(10) Patent No.: US 10,752,006 B2
(45) Date of Patent: Aug. 25, 2020

(54) FLOW PATH STRUCTURE BODY, LIQUID EJECTING APPARATUS, AND LIQUID EJECTING METHOD

(71) Applicant: SEIKO EPSON CORPORATION, Tokyo (JP)

(72) Inventor: Makoto Otsuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/169,930

(22) Filed: Oct. 24, 2018

(65) Prior Publication Data

US 2019/0118541 A1 Apr. 25, 2019

(30) Foreign Application Priority Data

Oct. 25, 2017 (JP) ..... 2017-206036

(51) Int. Cl.
*B41J 2/17* (2006.01)
*B41J 2/175* (2006.01)
*B41J 2/19* (2006.01)

(52) U.S. Cl.
CPC ..... *B41J 2/17513* (2013.01); *B41J 2/175* (2013.01); *B41J 2/17563* (2013.01); *B41J 2/19* (2013.01)

(58) Field of Classification Search
None
See application file for complete search history.

(56) References Cited

U.S. PATENT DOCUMENTS

2005/0104943 A1* 5/2005 Hida ..... B41J 2/17563 347/93
2010/0020139 A1* 1/2010 Yokouchi ..... B41J 2/175 347/85
2010/0289856 A1* 11/2010 Yamamoto ..... B41J 2/17509 347/85
2013/0141502 A1* 6/2013 Kobayashi ..... B41J 2/19 347/92
2015/0352855 A1 12/2015 Nawano et al.
2016/0250859 A1 9/2016 Nawano et al.

FOREIGN PATENT DOCUMENTS

JP 2015-231722 A 12/2015
JP 2017-65215 A 4/2017

* cited by examiner

*Primary Examiner* — Erica S Lin
(74) *Attorney, Agent, or Firm* — Workman Nydegger

(57) ABSTRACT

Provided is a flow path structure body including: a distribution flow path that is for distributing a liquid from a liquid supply source to a nozzle; an air bubble chamber that is connected to the distribution flow path and that is for storing air bubbles; and an air bubble chamber filter that is arranged to divide a space in the air bubble chamber into a first space that is connected to the distribution flow path and a second space that is connected to the distribution flow path via the first space, the air bubble chamber filter being for collecting foreign matters that have been formed at a gas-liquid interface in the air bubble chamber.

16 Claims, 6 Drawing Sheets

FLOW PATH STRUCTURE BODY, LIQUID EJECTING APPARATUS, AND LIQUID EJECTING METHOD

BACKGROUND

1. Technical Field

The present invention relates to a flow path structure body, a liquid ejecting apparatus, and a liquid ejecting method.

2. Related Art

In relation to a flow path structure body, JP-A-2015-231722, for example, discloses a flow path member that has a filter provided at a midpoint of a flow path and an air bubble chamber for storing air bubbles removed by the filter.

There is a possibility that foreign matters have been formed at a gas-liquid interface between gas and liquid that are stored in an air bubble chamber in a flow path member (flow path structure body) disclosed in JP-A-2015-231722. There is a possibility that nozzle clogging or the like occurs if the foreign matters that have been formed at the gas-liquid interface flow out to the flow path and flow to a nozzle. Even in a case in which a filter is provided in the flow path on a downstream side beyond the air bubble chamber, there is a possibility that lifetime of the filter is degraded if the foreign matters that have been formed at the gas-liquid interface are accumulated at the filter.

SUMMARY

The invention can be realized in the following aspects.

(1) According to an aspect of the invention, there is provided a flow path structure body. The flow path structure body includes: a distribution flow path that is for distributing a liquid from a liquid supply source to a nozzle; an air bubble chamber that is connected to the distribution flow path and that is for storing air bubbles; an air bubble chamber filter that is arranged such that the air bubble chamber filter divides a space in the air bubble chamber into a first space that is connected to the distribution flow path and a second space that is connected to the distribution flow path via the first space, the air bubble chamber filter being for collecting foreign matters that have been formed at a gas-liquid interface in the air bubble chamber. According to the flow path structure body in the aspect, the foreign matters that have been formed at the gas-liquid interface in the air bubble chamber are collected by the air bubble chamber filter provided in the air bubble chamber. Therefore, it is possible to suppress flowing-out of the foreign matters that have been formed at the gas-liquid interface in the air bubble chamber to the distribution flow path and flowing of the foreign matters to the nozzle and to suppress nozzle clogging due to the foreign matters.

(2) The flow path structure body may further include: a flow path filter that is arranged in the distribution flow path and that is for collecting foreign matters included in the liquid that flows through the distribution flow path, in which roughness of a mesh of the air bubble chamber filter may be finer than roughness of a mesh of the flow path filter. According to the flow path structure body in the aspect, it is possible to collect the foreign matters that has occurred at the gas-liquid interface in the air bubble chamber with the air bubble chamber filter even if the foreign matters have sizes with which the foreign matters pass through the flow path filter, and to thereby further suppress nozzle clogging due to the foreign matters.

(3) In the flow path structure body, the flow path structure body may be detachably connected to a liquid ejecting head that includes the nozzle, and roughness of a mesh of the air bubble chamber filter may be finer than roughness of a mesh of a head filter that is arranged in a head flow path of the liquid ejecting head and is for collecting foreign matters included in the liquid that flows through the head flow path. According to the flow path structure body in the aspect, there is a high possibility that the air bubble chamber filter causes clogging earlier than the head filter since the roughness of the mesh of the air bubble chamber filter is finer than the roughness of the mesh of the head filter. In a case in which the air bubble chamber filter has caused clogging, it is possible to replace the flow path structure body that is detachably connected to the liquid ejecting head. Therefore, it is possible to collect the foreign matters again with the air bubble chamber filter by replacing the flow path structure body and to thereby suppress accumulation of the foreign matters at the head filter and to extend the lifetime of the liquid ejecting head.

(4) In the flow path structure body, the air bubble chamber filter may be lyophilic. According to the flow path structure body in the aspect, the liquid easily pass through the air bubble chamber filter, and it is possible to suppress adhesion of air bubbles to the air bubble chamber filter. Therefore, it is possible to suppress formation of the gas-liquid interface that serves as a generation source of foreign matters at the surface of the air bubble chamber filter on the side of the distribution flow path.

(5) In the flow path structure body, the air bubble chamber filter may be arranged such that the air bubble chamber filter is inclined with respect to a horizontal direction in the air bubble chamber. According to the flow path structure body in the aspect, it is possible to extend the lifetime of the air bubble chamber filter since a position at which the air bubble chamber filter and the gas-liquid interface are brought into contact with each other changes in accordance with lowering of the gas-liquid interface that accompanies the accumulation of the air bubbles.

(6) The flow path structure body may further include: a valve mechanism that is arranged on a downstream side of the air bubble chamber and opens and closes the distribution flow path in accordance with a pressure of the liquid on a downstream side beyond the distribution flow path. According to the flow path structure body in the aspect, it is possible to suppress flowing of the foreign matters that have been formed at the gas-liquid interface in the air bubble chamber to the valve mechanism that is provided on the downstream side beyond the air bubble chamber and to suppress the foreign matters caught by the valve body of the valve mechanism.

(7) The flow path structure body may further include: a flow path filter that is arranged in the distribution flow path and that is for collecting foreign matters included in the liquid that flows through the distribution flow path; and a valve mechanism that is arranged on an upstream side of the flow path filter and opens and closes the distribution flow path in accordance with a pressure of the liquid on a downstream side beyond the distribution flow path, in which the air bubble chamber may be connected between the valve mechanism and the flow path filter. According to the flow path structure body in the aspect, it is possible to store the air bubbles in the air bubble chamber provided on the downstream side beyond the valve mechanism even if the air bubbles have been formed in conjunction with opening and closing operations of the valve mechanism, and it is possible to collect foreign matters with the air bubble chamber filter even if the foreign matters have been formed at the gas-liquid interface in the air bubble chamber. Therefore, it is possible to suppress flowing of the air bubbles and the foreign matters to the nozzle. In addition, it is possible to suppress a decrease in the lifetime of the flow path filter due to accumulation of the foreign matters that have been formed at the gas-liquid interface in the air bubble chamber at the flow path filter provided on the downstream side beyond the air bubble chamber.

The invention can be realized in various modes other than the aforementioned flow path structure body. For example, the invention can be realized by modes such as a liquid ejecting apparatus, a liquid ejecting method, a foreign matter removing filter, and a liquid ejecting unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
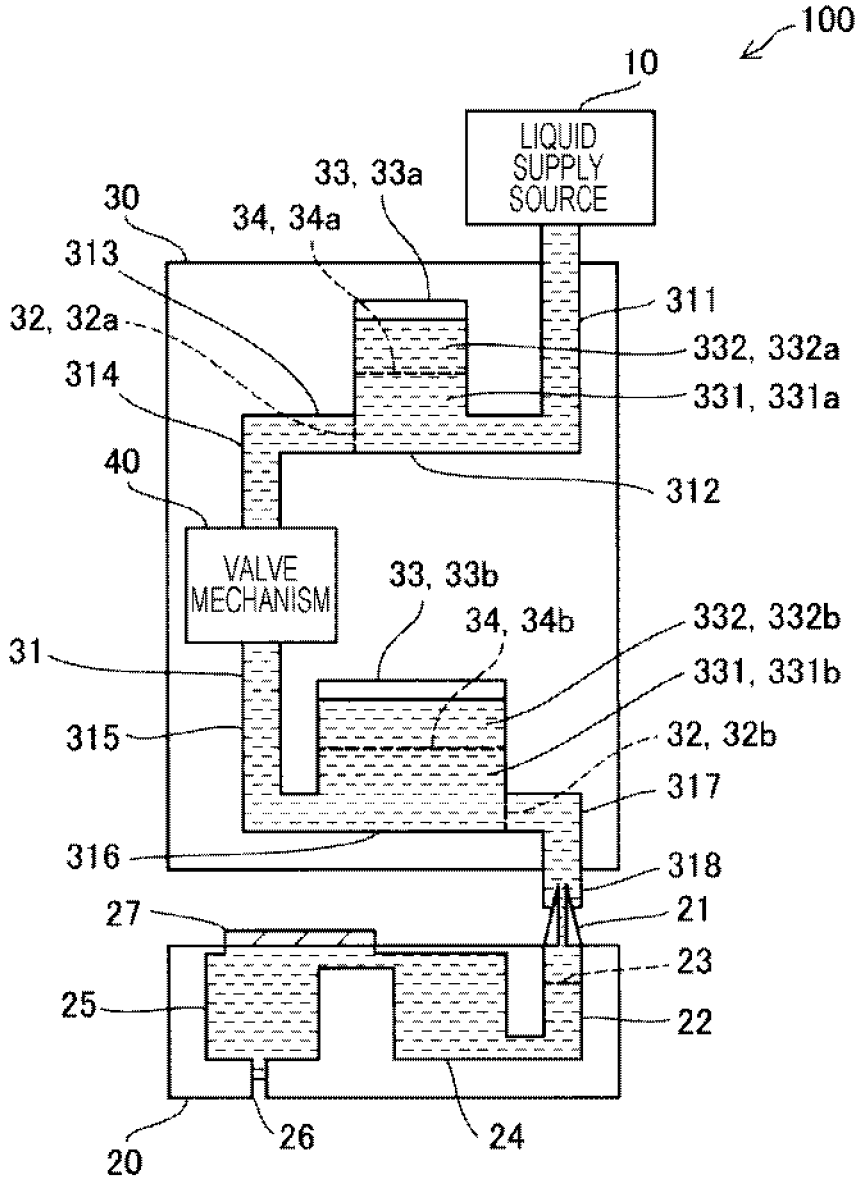
FIG. 1 is an explanatory diagram illustrating an outline of a liquid ejecting apparatus according to a first embodiment.

FIG. 1 is an explanatory diagram illustrating an outline of a liquid ejecting apparatus 100 according to a first embodiment. The liquid ejecting apparatus 100 according to the embodiment is configured as an ink jet printer including a liquid ejecting head 20 that has a nozzle 26 for ejecting ink (liquid) that has been supplied from a liquid supply source 10 and a flow path structure body 30 that is connected between the liquid supply source 10 and the liquid ejecting head 20 and that distributes the ink that has been supplied from the liquid supply source 10 to the liquid ejecting head 20. The flow path structure body 30 is detachably connected to the liquid ejecting head 20. The liquid ejecting head 20 and the flow path structure body 30 will be collectively referred to as a "liquid ejecting unit" in some cases.

The liquid supply source 10 is an ink supply source. The liquid supply source 10 according to the embodiment is an ink cartridge that is formed such that the liquid supply source 10 can be attached to and detached from the liquid ejecting apparatus 100. The ink may be pigment ink or dye ink. The liquid ejecting apparatus 100 may be an off-carriage-type printer with the liquid supply source 10 not provided on the liquid ejecting head 20 or may be an on-carriage-type printer with the liquid supply source 10 provided on the liquid ejecting head 20. The liquid ejecting apparatus 100 may include a pump that suctions the ink from the ink cartridge and pressurizes and supplies the ink. Although the liquid supply source 10 can be attached to and detached from the liquid ejecting apparatus 100 in the embodiment, the liquid supply source 10 may be formed as a tank that is secured to the liquid ejecting apparatus 100. In this case, the tank is filled with the ink from a bottle that accommodates the ink as needed.

The liquid ejecting head 20 includes a supply needle 21, a head flow path 22, a reservoir 24, a head pressure chamber 25, and a nozzle 26, and the ink flows in this order. The supply needle 21 is inserted into a distribution flow path 31 of the flow path structure body 30 and introduces the ink from the distribution flow path 31 into the head flow path 22. Sealing is provided between the supply needle 21 and the distribution flow path 31 to prevent the ink from leaking therefrom. A contact point of the ink may be secured between the flow path structure body 30 and the liquid ejecting head 20, instead of the supply needle 21. The ink that has been introduced into the head flow path 22 flows to the reservoir 24 via a head filter 23 provided in the head flow path 22. The head filter 23 is a filter for collecting foreign matters included in the ink. The reservoir 24 communicates with the head pressure chamber 25 and once stores the ink to be supplied to the head pressure chamber 25.

The head pressure chamber 25 communicates with the nozzle 26. A piezoelectric actuator 27 is provided in the head pressure chamber 25. If the volume of the head pressure chamber 25 is made to contract by the piezoelectric actuator 27 being driven, and the pressure in the head pressure chamber 25 exceeds resistance to the pressure of meniscus of the ink in the nozzle 26, then the ink is ejected from the nozzle 26. Meanwhile, if the volume of the head pressure chamber 25 is enlarged by the piezoelectric actuator 27 being driven, and a negative pressure is achieved in the head pressure chamber 25, then the ink is supplied from the reservoir 24. Note that the ink is supplied from the size of the head flow path 22 to the reservoir 24 since the pressure in the reservoir 24 is also reduced at this time. Note that the liquid ejecting head 20 is not limited to the aforementioned piezoelectric scheme and may be of a thermal scheme, for example.

Figure 2:
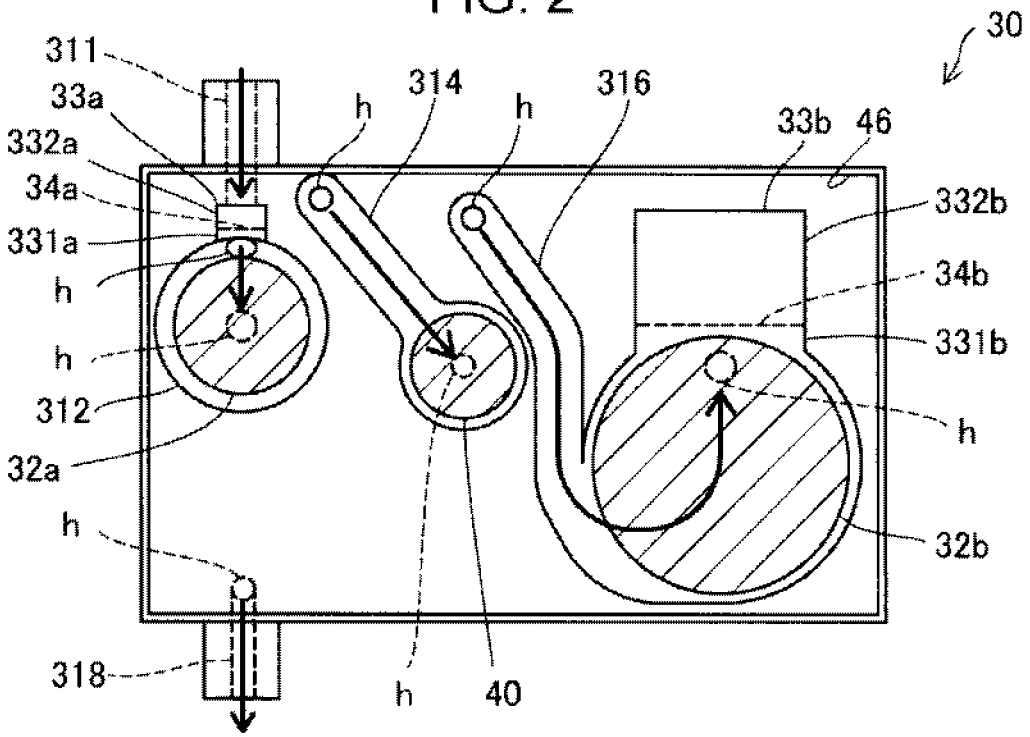
FIG. 2 is a front view illustrating an outline of a flow path structure body according to the first embodiment.
Figure 3:
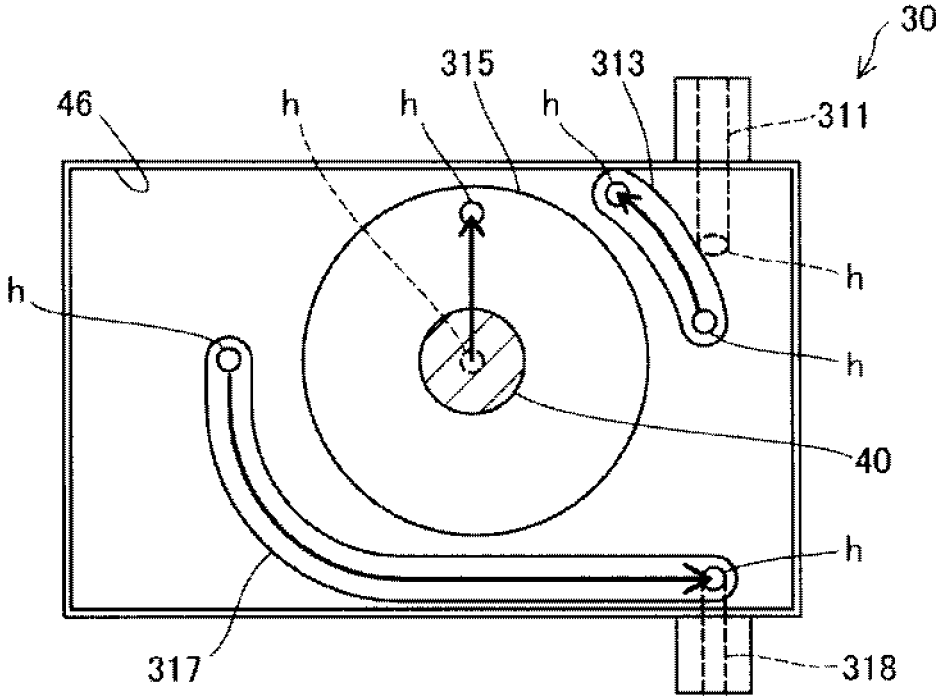
FIG. 3 is a back view illustrating an outline of the flow path structure body according to the first embodiment.

FIG. 2 is a front view illustrating an outline configuration of the flow path structure body 30. FIG. 3 is a back view illustrating an outline configuration of the flow path structure body 30. Hereinafter, a structure of the flow path structure body 30 will be described with reference to FIGS. 1 to 3. The main body of the flow path structure body 30 according to the embodiment is formed of polypropylene (PP), for example. The distribution flow path 31 is provided in a front surface of the flow path structure body 30. The distribution flow path 31 is a flow path, which is surrounded by a groove that is formed in a front surface of the main body of the flow path structure body 30 and a film member 46 that is welded to the front surface of the main body of the flow path structure body 30, through which the ink is distributed. Similarly, the distribution flow path 31 is also provided in the back surface of the flow path structure body 30 by the groove and the film member 46. The distribution flow path 31 has a first distribution flow path 311, a second distribution flow path 312, a third distribution flow path 313, a fourth distribution flow path 314, a fifth distribution flow path 315, a sixth distribution flow path 316, a seventh distribution flow path 317, and an eighth distribution flow path 318, and the ink flows in this order. The respective distribution flow paths 311 to 318 are connected by the through-hole h that penetrates the front surface and the back surface of the main body of the flow path structure body 30. Note that the arrows illustrated in FIGS. 2 and 3 represent directions in which the ink flows.

A first flow path filter 32*a* is provided between the second distribution flow path 312 and the third distribution flow path 313. A second flow path filter 32*b* is provided between the sixth distribution flow path 316 and the seventh distribution flow path 317. Hereinafter, the first flow path filter 32*a* and the second flow path filter 32*b* will be referred to as a flow path filter 32 in a case in which the first flow path filter 32*a* and the second flow path filter 32*b* will be described while not particularly distinguished from each other.

The flow path filter 32 is a filter that is for collecting foreign matters and air bubbles that are included in the ink that flows through the distribution flow path 31 and suppressing flowing-out of the foreign matters and the air bubbles to the nozzle 26. In the embodiment, the flow path filter 32 has a circular shape and is formed of a mesh-shaped stainless steel. Note that the second flow path filter 32*b* is larger than the first flow path filter 32*a* (see FIG. 2).

A first air bubble chamber 33*a* is provided above the second distribution flow path 312 in the vertical direction. A second air bubble chamber 33*b* is provided above the sixth distribution flow path 316 in the vertical direction. Hereinafter, the first air bubble chamber 33*a* and the second air bubble chamber 33*b* will be referred to as an air bubble chamber 33 in a case in which the first air bubble chamber 33*a* and the second air bubble chamber 33*b* will be described while not particularly distinguished from each other.

The air bubble chamber 33 is a space in which the air bubbles included in the ink that flows through the distribution flow path 31 are stored. Flowing of the air bubbles to the nozzle 26 is suppressed by the air bubble chamber 33 storing the air bubbles therein. In the embodiment, the first air bubble chamber 33*a* is provided on the upstream side of the first flow path filter 32*a*, and the air bubbles collected by the first flow path filter 32*a* are stored in the first air bubble chamber 33*a*. The second air bubble chamber 33*b* is provided on the upstream side of the second flow path filter 32*b*, and the air bubbles collected by the second flow path filter 32*b* are stored in the second air bubble chamber 33*b*. Note that the volume of the second air bubble chamber 33*b* that is provided on the downstream side beyond the valve mechanism 40 is larger than the volume of the first air bubble chamber 33*a* that is provided on the upstream side beyond the valve mechanism 40 since the air bubbles tend to occur in conjunction with opening and closing operations of the valve mechanism 40 (see FIG. 2).

A first air bubble chamber filter 34*a* is provided in the first air bubble chamber 33*a*. A second air bubble chamber filter 34*b* is provided in the second air bubble chamber 33*b*. Hereinafter, the first air bubble chamber filter 34*a* and the second air bubble chamber filter 34*b* will be referred to as an air bubble chamber filter 34 in a case in which the first air bubble chamber filter 34*a* and the second air bubble chamber filter 34*b* will be described while not particularly distinguished from each other.

The air bubble chamber filter 34 is arranged such that the air bubble chamber filter 34 divides a space in the air bubble chamber 33 into a first space 331 that is connected to the distribution flow path 31 and a second space 332 that is connected to the distribution flow path 31 via the first space 331. In the embodiment, the air bubble chamber filter 34 is arranged in the horizontal direction during use when the liquid is distributed to the flow path structure body 30, and the space in the air bubble chamber 33 is divided into upper and lower portions in the vertical direction by the air bubble chamber filter 34. In the space in the air bubble chamber 33, the space below the air bubble chamber filter 34 (the side of the distribution flow path 31) in the vertical direction corresponds to the first space 331 while the space above the air bubble chamber filter 34 in the vertical direction corresponds to the second space 332. Note that the space in the first air bubble chamber 33*a* is divided into a first space 331*a* and a second space 332*a* by the first air bubble chamber filter 34*a* while the space in the second air bubble chamber 33*b* is divided into the first space 331*b* and the second space 332*b* by the second air bubble chamber filter 34*b*.

The air bubble chamber filter 34 is a filter for collecting foreign matters that have been formed at the gas-liquid interface in the air bubble chamber 33. The air bubble chamber filter 34 according to the embodiment is formed of a mesh-shaped stainless steel. The air bubble chamber filter 34 may be made of resin or glass. In the embodiment, since the second air bubble chamber 33*b* is larger than the first air bubble chamber 33*a* and has a larger area of the gas-liquid interface, the second air bubble chamber filter 34*b* that is provided in the second air bubble chamber is larger than the first air bubble chamber filter 34*a* that is provided in the first air bubble chamber 33*a* (see FIG. 2).

Roughness of mesh of the air bubble chamber filter 34 is finer than roughness of mesh of the flow path filter 32 in the embodiment. The roughness of the mesh of the air bubble chamber filter 34 is finer than roughness of the mesh of the head filter 23 that is arranged in the head flow path 22 of the liquid ejecting head 20 and is for collecting the foreign matters included in the ink that flows through the head flow path 22. Note that the roughness of the mesh of the air bubble chamber filter 34 is not limited to thereto and may be such a size with which the foreign matters that have been formed at the gas-liquid interface can be collected and the ink can be made to pass therethrough.

A lyophilic property is provided to the air bubble chamber filter 34 according to the embodiment through plasma irradiation, silica coating, or the like. "Lyophilic property" means a state in which wettability is satisfactory and a contact angle between a sold (filter) and a liquid (ink) is small. Note that the air bubble chamber filter 34 does not have a lyophilic property.

The valve mechanism 40 is provided between the fourth distribution flow path 314 and the fifth distribution flow path 315. The valve mechanism 40 opens and closes between the fourth distribution flow path 314 and the fifth distribution flow path 315 in accordance with a pressure of the ink on the downstream side (the side of the liquid ejecting head 20) beyond the distribution flow path 31.

Figure 4:
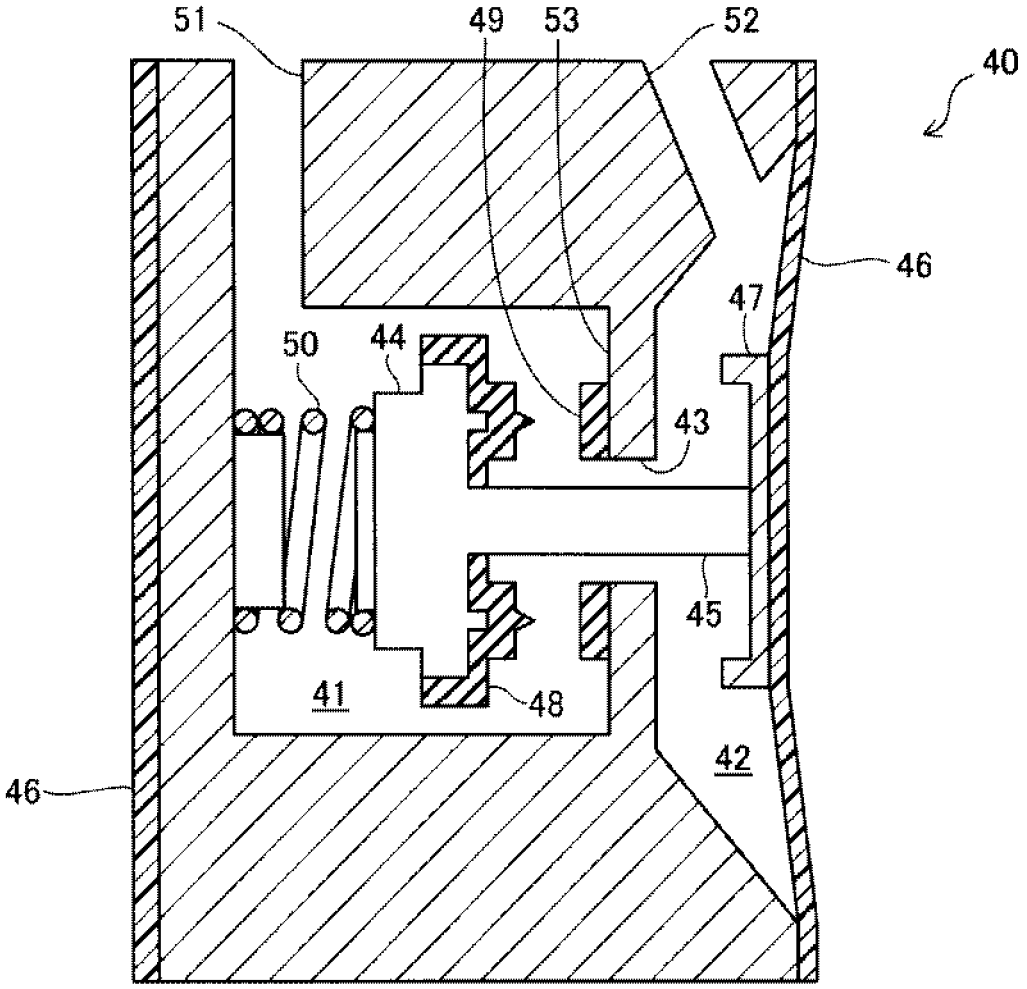
FIG. 4 is a sectional view schematically illustrating an outline of a valve mechanism according to the first embodiment.

FIG. 4 is a sectional diagram schematically illustrating an outline configuration of the valve mechanism 40. The valve mechanism 40 closes an internal vale such that the ink is not supplied to the side of the liquid ejecting head 20 if the pressure on the side of the liquid ejecting head 20 is equal to or greater than a predetermined pressure and opens the internal valve and supplies the ink, which has been supplied from the liquid supply source 10, to the side of the liquid ejecting head 20 in a case in which the pressure on the side of the liquid ejecting head 20 falls below the predetermined pressure. The valve mechanism 40 can be also referred to as a "self-sealing valve" or a "differential pressure valve". The valve mechanism 40 also has a function of sectioning a negative pressure state in the liquid ejecting head 20 and a positive pressure state on the side of the liquid supply source 10 such that compression force does not act directly on the liquid ejecting head 20 in the negative pressure state from the liquid supply source 10.

FIG. 4 illustrates a state in which the ink has been suctioned from the liquid ejecting head 20 and the internal valve body 44 is in an opened state. The valve mechanism 40 includes a liquid supply chamber 41 that is connected to the distribution flow path 31 (fourth distribution flow path 314) on the side of the liquid supply source 10 and a pressure chamber 42 that is connected to the distribution flow path 31 (fifth distribution flow path 315) on the side of the liquid ejecting head 20. The liquid supply chamber 41 and the pressure chamber 42 are sectioned by the compartment wall 53. The ink is supplied from the side of the liquid supply source 10 to the liquid supply chamber 41 through a supply port 51. The ink is discharged from the pressure chamber 42 to the side of the liquid ejecting head 20 through a discharging port 52. A communication hole 43 is formed in the compartment wall 53. The internal space in the liquid supply chamber 41 and the internal space in the pressure chamber 42 communicate with each other through the communication hole 43.

A substantially disk-shaped valve body 44 is arranged in the liquid supply chamber 41. The valve body 44 has a columnar-shaped shaft 45 that projects to the side of the pressure chamber 42. The shaft 45 passes through the communication hole 43, and a tip end thereof is located in the pressure chamber 42. The tip end of the shaft 45 can be brought into contact with a film member 46, which defines a part of the pressure chamber 42, via the pressure receiving plate 47.

The ink inside the liquid supply chamber 41 flows into the pressure chamber 42 through between the shaft 45 and an inner surface of the communication hole 43. The valve body 44 includes an annular seal member 48 with the shaft 45 located at the center thereof, in the surface that faces the side of the pressure chamber 42. A valve seat 49 is provided in the surface that faces the side of the pressure chamber 42 in the surroundings of the communication hole 43 of the compartment wall 53. The seal member 48 provided at the valve body 44 is brought into annular contact with the valve seat 49 in a state in which the valve body 44 is closed. The distribution of the ink from the liquid supply chamber 41 to the pressure chamber 42 is blocked by the seal member 48 being brought into contact with the valve seat 49. Note that the valve seat 49 may not be an independent member, and the surface that faces the side of the valve body 44 of the compartment wall 53 may function as the valve seat.

A spring member 50 is arranged between a surface on a side opposite to the side of the pressure chamber 42 of the valve body 44 and a case body of the valve mechanism 40. The spring member 50 is a member for bringing the valve body 44 into a closed state and pushes the valve body 44 against the valve seat 49. Note that a spring member may also be arranged between the pressure receiving plate 47 and the compartment wall 53 in the valve mechanism 40 in addition to the spring member 50. In addition, the distribution of the ink may be blocked without arranging the spring member 50 and by arranging the valve mechanism 40 such that the shaft 45 faces downward in the vertical direction and bringing the seal member 48 of the valve body 44 into contact with the valve seat 49 by its own weight of the valve body 44, for example.

The film member 46 has flexibility. The film member 46 moves the valve body 44 and brings the valve body 44 into the opened state by being deflected in a case in which the pressure in the pressure chamber 42 falls. Specifically, if the pressure in the pressure chamber 42 becomes a negative pressure that is lower than the atmospheric air pressure, the film member 46 is deflected in a direction in which the volume of the pressure chamber 42 decreases (on the left side in the drawing). Then, a pressure receiving plate 47 provided at the film member 46 pushes the tip end of the shaft 45 and moves the valve body 44 in a direction away from the valve seat 49. Therefore, the valve mechanism 40 can control the distribution of the ink from the liquid supply source 10 to the liquid ejecting head 20 without being driven by other power, by the valve body 44 moving therein in accordance with the pressure in the pressure chamber 42, that is, the pressure on the side of the liquid ejecting head 20.

Figure 5:
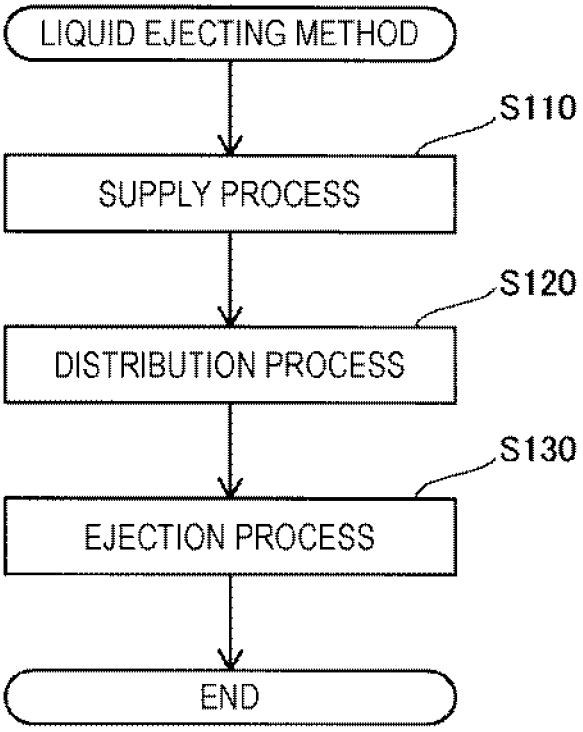
FIG. 5 is a flowchart illustrating details of liquid ejecting method according to the first embodiment.

FIG. 5 is a flowchart illustrating details of a liquid ejecting method that is performed by the liquid ejecting apparatus 100. It is assumed that the distribution flow path 31, the air bubble chamber 33, the valve mechanism 40, and the head flow path 22 are filled with the ink before the method is performed. First, the valve mechanism 40 is opened, and the ink is supplied from the liquid supply source 10 to the flow path structure body 30 in conjunction with occurrence of the negative pressure on the side of the liquid ejecting head 20. This process will be referred to as a "supply process" (Step S110). Then, the ink that has been supplied to the flow path structure body 30 is distributed to the nozzle 26 of the liquid ejecting head 20 via the distribution flow path 31. This process will be referred to as a "distribution process" (Step S120). Then, the ink is ejected from the nozzle 26 by the piezoelectric actuator 27 being driven. This process will be referred to as an "ejection process" (Step S130).

In the distribution process in Step S120, air bubbles included in the ink that flows through the distribution flow path 31 are collected by the flow path filter 32 provided in the distribution flow path 31 and are stored in the air bubble chamber 33 connected to the distribution flow path 31 on the upstream side of the flow path filter 32. Since the air bubble chamber 33 is filled with the ink in the initial state, the gas-liquid interface in the air bubble chamber 33 is gradually lowered if the air bubbles are stored.

At the gas-liquid interface between the air (air bubbles) and the ink stored in the air bubble chamber 33, the surface of the ink tends to be dried since the ink is in contact with the air. There is a case in which the ink is locally condensed due to the dried ink surface, dispersion breakage occurs, and resins as constituents of the ink are coupled to each other to form large particles, which become foreign matters. Since the foreign matters are particles of the coupled resins as constituents of the ink, the foreign particles tend not to be dissolved again in the ink and tend to remain as foreign matters once they occur. If the foreign matters that have been formed at the gas-liquid interface grow, the specific gravity thereof becomes larger than that of the ink, and the foreign matters are likely to flow to the side of the distribution flow path 31. However, since the air bubble chamber filter 34 is provided between the gas-liquid interface in the air bubble chamber 33 and the distribution flow path 31, the foreign matters are collected by the air bubble chamber filter 34 before flowing out to the distribution flow path 31.

According to the flow path structure body 30 of the aforementioned embodiment, the foreign matters that have been formed at the gas-liquid interface in the air bubble chamber 33 are collected by the air bubble chamber filter 34 provided in the air bubble chamber 33. Therefore, it is possible to suppress flowing-out of the foreign matters that have been formed at the gas-liquid interface in the air bubble chamber 33 to the distribution flow path 31 and flowing to the nozzle 26 and to thereby suppress clogging of the nozzle 26 due to the foreign matters.

Since the roughness of the mesh of the air bubble chamber filter 34 is finer than the roughness of the mesh of the flow path filter 32 in the embodiment, it is possible to collect the foreign matters that have been formed at the gas-liquid interface in the air bubble chamber 33 with the air bubble chamber filter 34 even if the foreign matters have sizes with which the foreign matters pass through the flow path filter 32 since the roughness of the mesh of the air bubble chamber filter 34 is finer than the roughness of the mesh of the flow path filter 32, and to thereby further suppress the clogging of the nozzle 26 due to the foreign matters.

Since the roughness of the mesh of the air bubble chamber filter 34 is finer than the roughness of the mesh of the head filter 23 in the embodiment, there is a high possibility that clogging occurs at the air bubble chamber filter 34 earlier than the head filter 23. In the case in which clogging has occurred at the air bubble chamber filter 34, the flow path structure body 30 detachably connected to the liquid ejecting head 20 can be replaced. Therefore, it is possible to collect foreign matters again with the air bubble chamber filter 34 by replacing the flow path structure body 30 and to thereby suppress accumulation of the foreign matters at the head filter 23 and to extend the lifetime of the liquid ejecting head 20.

Since the air bubble chamber filter 34 has a lyophilic property in the embodiment, the ink tends to pass through the air bubble chamber filter 34, and it is possible to suppress adhesion of the air bubbles to the surface of the air bubble chamber filter 34 on the side of the distribution flow path 31. Therefore, it is possible to suppress formation of the gas-liquid interface that serves as a generation source of the foreign matters on the surface of the air bubble chamber filter 34 on the side of the distribution flow path 31.

The foreign matters that have been formed at the gas-liquid interface in the first air bubble chamber 33*a* are collected by the first air bubble chamber filter 34*a* in the embodiment. Therefore, it is possible to suppress flowing of the foreign matters that have been formed at the gas-liquid interface in the first air bubble chamber 33*a* to the valve mechanism 40 provided on the downstream side beyond the first air bubble chamber 33*a*, and to thereby suppress the foreign matters caught by the valve body 44 of the valve mechanism 40.

Since the second air bubble chamber 33*b* is connected between the valve mechanism 40 and the second flow path filter 32*b* in the embodiment, it is possible to store air bubbles in the second air bubble chamber 33*b* provided on the downstream side beyond the valve mechanism 40 even if the air bubbles occur in conjunction with the opening and closing operations of the valve mechanism 40, and to collect foreign matters by the second air bubble chamber filter 34*b* even if the foreign matters occur at the gas-liquid interface in the second air bubble chamber 33*b*. Therefore, it is possible to suppress flowing of the air bubbles and the foreign matters to the nozzle 26. Also, it is possible to suppress accumulation of the foreign matters, which have been formed at the gas-liquid interface in the second air bubble chamber 33*b*, at the second flow path filter 32*b* provided on the downstream side beyond the second air bubble chamber 33*b* and to suppress a decrease in the lifetime of the second flow path filter 32*b*.

B. Second Embodiment

Figure 6:
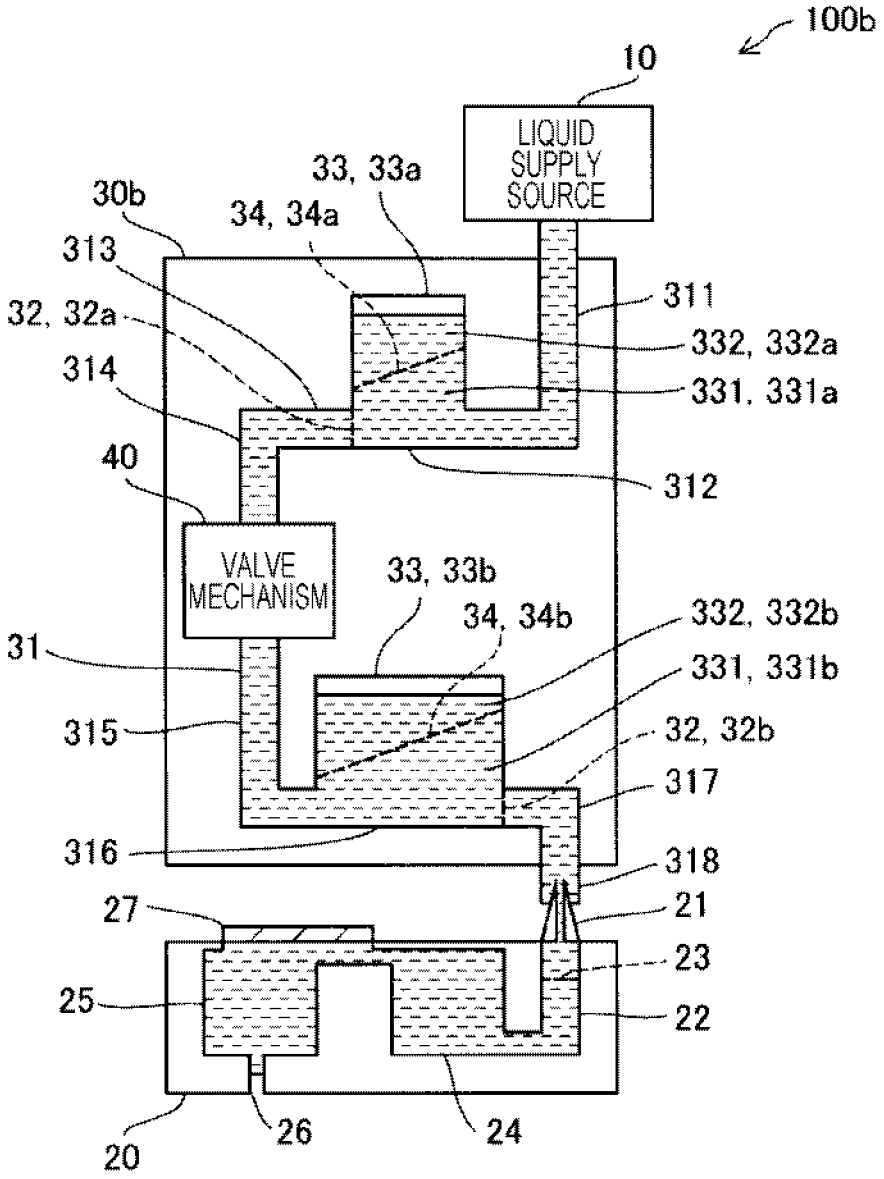
FIG. 6 is an explanatory diagram illustrating an outline of a liquid ejecting apparatus according to a second embodiment.

FIG. 6 is an explanatory diagram illustrating an outline of a liquid ejecting apparatus 100*b* according to a second embodiment. The liquid ejecting apparatus 100*b* according to the second embodiment is different from the first embodiment (FIG. 1) in the arrangement of the air bubble chamber filter 34 provided in the air bubble chamber 33. In the flow path structure body 30 according to the first embodiment as illustrated in FIG. 1, the air bubble chamber filter 34 is arranged in the horizontal direction during use when the liquid is distributed through the flow path structure body 30, and the space in the air bubble chamber 33 is divided into upper and lower portions in the vertical direction by the air bubble chamber filter 34. Meanwhile, in the flow path structure body 30*b* according to the embodiment, the air bubble chamber filter 34 is arranged while inclined relative to the horizontal direction as illustrated in FIG. 6 during use when the liquid is distributed through the flow path structure body 30*b*. It is possible to collect the foreign matters that have been formed at the gas-liquid interface with the air bubble chamber filter 34 even in the flow path structure body 30*b* in this mode. Also, it is possible to increase the area of the air bubble chamber filter 34 as compared with the case in which the air bubble chamber filter 34 is arranged in the horizontal direction. Further, since the position at which the air bubble chamber filter 34 and the gas-liquid interface are brought into contact with each other changes in accordance with lowering of the gas-liquid interface in conjunction with the accumulation of the air bubbles, it is possible to increase the amount of the foreign matters that the air bubble chamber filter 34 can collect. Therefore, it is possible to extend the lifetime of the air bubble chamber filter 34.

C. Third Embodiment

Figure 7:
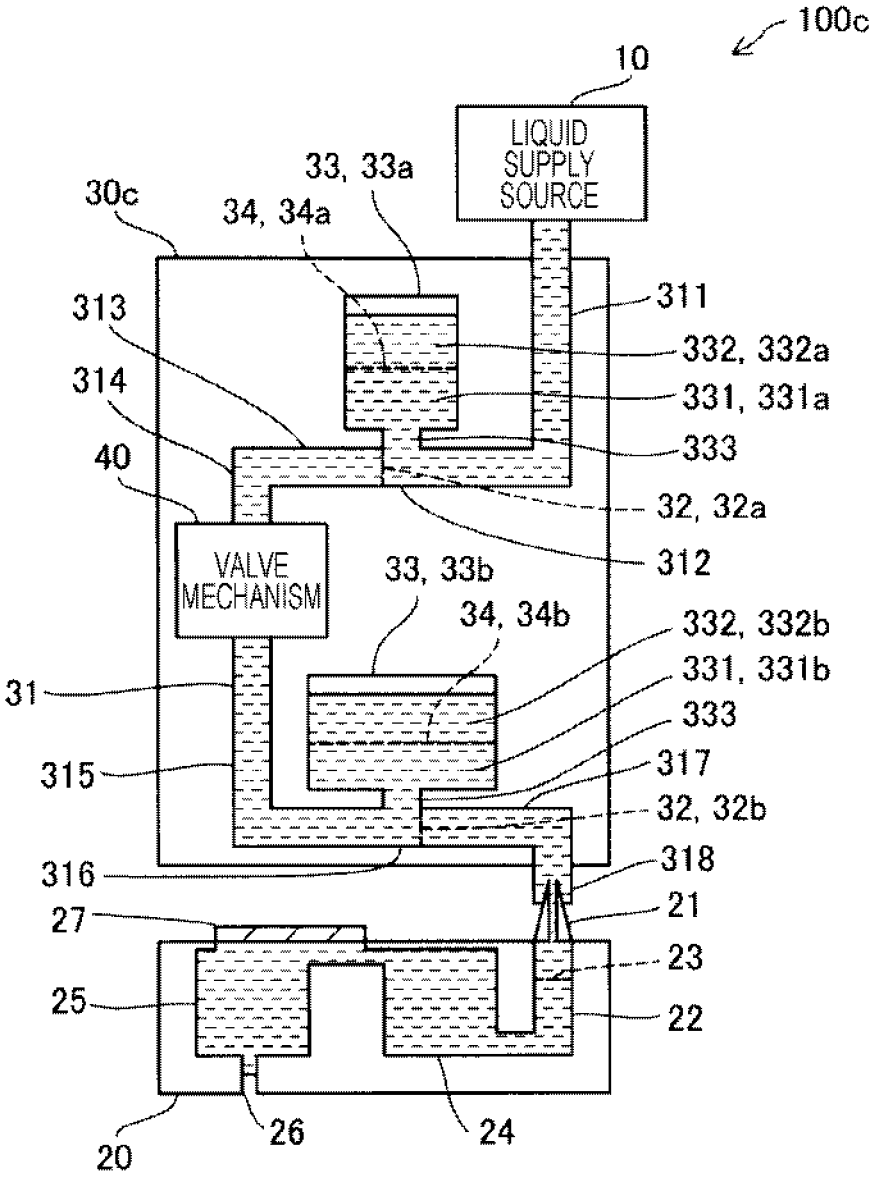
FIG. 7 is an explanatory diagram illustrating an outline of a liquid ejecting apparatus according to a third embodiment.

FIG. 7 is an explanatory diagram illustrating an outline of a liquid ejecting apparatus 100*c* according to a third embodiment. The liquid ejecting apparatus 100*c* according to the third embodiment is different from the first embodiment (FIG. 1) in the structure of the air bubble chamber 33. In the flow path structure body 30 according to the first embodiment as illustrated in FIG. 1, the air bubble chamber 33 is connected directly to the distribution flow path 31. Meanwhile, in the flow path structure body 30*c* according to the embodiment, the air bubble chamber 33 is connected to the distribution flow path 31 via a branching flow path 333 as illustrated in FIG. 7. The air bubble chamber 33 can store the air bubbles, and the foreign matters that have been formed at the gas-liquid interface can be collected with the air bubble chamber filter 34 even in the flow path structure body 30*c* in this mode.

D. Other Embodiments (D-1) In the air bubble chamber 33 as illustrated in FIG. 1, the number of air bubble chamber filters 34 provided in each air bubble chamber 33 is one. In contrast, a plurality of air bubble chamber filters 34 may be provided in the air bubble chamber 33. For example, one air bubble chamber filter 34 can be provided on each of upper and lower sides in the vertical direction in the air bubble chamber 33. In the flow path structure body 30 in this mode, the foreign matters are accumulated at the air bubble chamber filter 34 on the upper side in the vertical direction, which is closer to the gas-liquid interface, first. Then, even if the gas-liquid interface is lowered to between the air bubble chamber filter 34 on the upper side in the vertical direction and the air bubble chamber filter 34 on the lower side in the vertical direction in conjunction with an increase in the air (air bubbles) in the air bubble chamber 33, the foreign matters can be further collected with the air bubble chamber filter 34 on the lower side in the vertical direction. Therefore, even if the air bubble chamber filter 34 on the upper side in the vertical direction cannot collect foreign matters any more due to clogging or the like, it is possible to collect the foreign matters that have been formed at the gas-liquid interface with the air bubble chamber filter 34 on the lower side in the vertical direction.

(D-2) In the flow path structure body 30 as illustrated in FIG. 1, the flow path structure body 30 includes the first air bubble chamber 33*a* and the second air bubble chamber 33*b*. Meanwhile, either the first air bubble chamber 33*a* or the second air bubble chamber 33*b* may be omitted from the flow path structure body 30. Alternatively, the flow path structure body 30 may include three or more air bubble chambers 33. Even in the flow path structure body 30 in this mode, it is possible to collect the foreign matters that have been formed at the gas-liquid interface.

(D-3) The flow path structure body 30 that includes the air bubble chamber 33 may be provided in an ink cartridge. According to the flow path structure body 30 in this mode, it is possible to collect foreign matters that have been formed at a gas-liquid interface in the ink cartridge.

(D-4) The flow path structure body 30 may not include the flow path filter 32. It is possible to collect foreign matters that have been formed at the gas-liquid interface in the air bubble chamber 33 with the air bubble chamber filter 34 and to thereby suppress flowing of the foreign matters to the nozzle 26 even in this case.

(D-5) The flow path structure body 30 may not be detachably connected to the liquid ejecting head 20. That is, the flow path structure body 30 may be fixed to the liquid ejecting head 20. Also, the liquid ejecting head 20 may not include the head filter 23.

(D-6) The flow path structure body 30 may include a valve with another structure rather than the valve mechanism 40 with the aforementioned structure. For example, the flow path structure body 30 may include a butterfly valve, and the distribution flow path 31 may be opened and closed by the butterfly valve. Alternatively, the flow path structure body 30 may not include a valve for opening and closing the distribution flow path 31 like the valve mechanism 40.

(D-7) The invention is not limited to a liquid ejecting apparatus that ejects ink and can also be applied to any liquid ejecting apparatuses that eject a liquid other than ink. For example, the invention can be applied to various liquid ejecting apparatuses as follows:

(1) Image recording apparatuses such as facsimile apparatuses
(2) Color material ejecting apparatuses that are used to manufacture color filters for image display apparatuses such as liquid crystal displays
(3) Electrode material ejecting apparatuses that are used to form electrodes for organic electroluminescence (EL) displays, field emission displays (FED), and the like
(4) Liquid ejecting apparatuses that eject a liquid containing bioorganic substances that are used to manufacture biochips
(5) Sample ejection apparatuses such as precision pipettes
(6) Lubricant ejecting apparatuses
(7) Resin liquid ejecting apparatuses
(8) Liquid ejecting apparatuses that eject lubricants to precision machines such as watches and cameras in a pinpoint manner
(9) Liquid ejecting apparatuses that eject transparent resin liquid such as an ultraviolet curable resin liquid onto substrates for forming minute semispherical lenses (optical lenses) and the like that are used in optical communication elements and the like
(10) Liquid ejecting apparatuses that eject an acid or alkaline etching liquid for etching substrates and the like
(11) Liquid ejecting apparatuses that include liquid ejecting heads for ejecting small amounts of any other liquid droplets Note that "liquid droplets" mean a state of a liquid ejected from the liquid ejecting apparatus and includes a particle shape, a teardrop shape, and a tailed shape. Also, the "liquid" described herein may be any materials that can be consumed by the liquid ejecting apparatus. For example, the "liquid" may be materials in states in which the substances are in a liquid phase, and materials in liquid states with high or low viscosity and materials in liquid states, such as sol, gel water, other inorganic solvents, organic solvents, solutions, liquid-form resins, and liquid-form metals (metal melts) are also included in the "liquid". Also, the "liquid" includes not only liquids as one state of substances but also includes particles of functional materials made of solids such as a pigment or metal particles that are dissolved, dispersed, or mixed in a solvent. Representative examples of the liquid include ink, liquid crystals, and the like. Here, it is assumed that the ink encompasses various liquid-form compositions such as typical water-based ink, oil-based ink, gel ink, and holt melt ink.

The invention is not limited to the aforementioned embodiments and can be realized with various configurations without departing from the gist thereof. For example, technical features in the embodiment that correspond to the technical features in the respective embodiments described in the summary of the invention can be appropriately replaced or combined in order to solve a part or an entirety of the aforementioned problems or in order to achieve a part or an entirety of the aforementioned advantages. The technical features can appropriately be deleted as long as there is no description in the specification that the technical features are essential.

This application claims priority to Japanese Patent Application No. 2017-206036 filed on Oct. 25, 2017. The entire disclosure of Japanese Patent Application No. 2017-206036 is incorporated herein by reference.

What is claimed is:

1. A flow path structure body for distributing a liquid from a liquid supply source that supplies liquid to a liquid ejecting head that ejects liquid, comprising:

a first flow path that extends in a horizontal direction;

a second flow path that connects to the first flow path, extends in the horizontal direction, and is positioned nearer to the liquid ejecting head that the first flow path;

a third flow path that that connects to the second flow path, extends in the horizontal direction, and is positioned nearer to the liquid ejecting head than the second flow path;

an air bubble chamber for storing air bubbles, the air bubble chamber connected to the second flow path and extending in a vertical direction that crosses the horizontal direction; and an air bubble chamber filter arranged in the air bubble chamber to divide the air bubble chamber into a first space that is directly connected to the second flow path and a second space that is not directly connected to the second flow path, the air bubble chamber filter being for collecting foreign matters formed at a gas-liquid interface in the air bubble chamber.

2. The flow path structure body according to claim 1, further comprising:

a flow path filter arranged between the second flow path and the third flow path and being for collecting foreign matters included in the liquid, wherein roughness of a mesh of the air bubble chamber filter is finer than roughness of a mesh of the flow path filter.

3. The flow path structure body according to claim 1, wherein roughness of a mesh of the air bubble chamber filter is finer than roughness of a mesh of a head filter arranged in a head flow path of the liquid ejecting head, air bubble chamber filter being for collecting foreign matters included in the liquid flowing through the head flow path.

4. The flow path structure body according to claim 1, wherein the air bubble chamber filter is lyophilic.

5. The flow path structure body according to claim 1, wherein the air bubble chamber filter is arranged to be inclined with respect to a horizontal direction in the air bubble chamber.

6. The flow path structure body according to claim 1, further comprising:

a valve arranged on a downstream side of the air bubble chamber and configured to open and close the distribution flow path in accordance with a pressure of the liquid on a downstream side beyond the distribution flow path.

7. The flow path structure body according to claim 1, further comprising:

a valve configured to open and close a flow path, wherein the first flow path is nearer to the ejecting head than the air bubble chamber.

8. A liquid ejecting apparatus comprising:

a nozzle for ejecting a liquid supplied from a liquid supply source;

a first flow path that extends in a horizontal direction;

a second flow path that connects to the first flow path, extends in the horizontal direction, and is positioned nearer to a liquid ejecting head than the first flow path;

a third flow path that that connects to the second flow path, extends in the horizontal direction, and is positioned nearer to the liquid ejecting head than the second flow path;

an air bubble chamber for storing air bubbles, the air bubble chamber connected to the second flow path and extending in a vertical direction that crosses the horizontal direction; and an air bubble chamber filter arranged in the air bubble chamber to divide the air bubble chamber into a first space that is directly connected to the second flow path and a second space that is not directly connected to the second flow path, the air bubble chamber filter being for collecting foreign matters formed at a gas-liquid interface in the air bubble chamber.

9. A liquid ejecting method comprising:

supplying a liquid from a liquid supply source;

distributing the supplied liquid to a nozzle via a first flow path extending in a horizontal direction, a second flow path extending in the horizontal direction, and a third flow path extending in the horizontal direction, the second flow path being connected to the first flow path and being positioned nearer to the nozzle that the first flow path, the third flow path that being connected to the second flow path and being positioned nearer to the nozzle than the second flow path; and ejecting the liquid from the nozzle, wherein the distributing of the supplied liquid comprises, storing air bubbles in an air bubble chamber, the air bubble chamber connected to the second flow path and extending in a vertical direction that crosses the horizontal direction, and collecting foreign matters formed at a gas-liquid interface in the air bubble chamber by an air bubble chamber filter arranged in the air bubble chamber to divide the air bubble chamber into a first space that is directly connected to the second flow path and a second space that is not directly connected to the second flow path.

10. The flow path structure body according to claim 1, further comprising:

a valve configured to open and close a flow path, wherein the third flow path is nearer to the liquid supply source than the air bubble chamber.

11. The flow path structure body according to claim 1, wherein the air bubble chamber includes a first air bubble chamber and a second air bubble chamber that is positioned nearer to the liquid ejecting head, and wherein capacity of the second air bubble chamber is larger than the first air bubble chamber.

12. The flow path structure body according to claim 1, wherein the air bubble chamber is positioned at an upward side in a vertical direction than all of the first flow path, the second flow path and the third flow path.

13. The flow path structure body according to claim 1, wherein the air bubble chamber does not connect to other than the second flow path.

14. The flow path structure body according to claim 1, wherein the second space is connected to the second flow path through the first space.

15. The flow path structure body according to claim 1, wherein the first space is positioned between the second flow path and the second space in the vertical direction.

16. The flow path structure body according to claim 1, wherein the first flow path is positioned at an upstream side from the second flow path in a direction that the liquid flow, and wherein the second flow path is positioned at an upstream side from the third flow path in a direction that the liquid flow.

* * * * *